United States Patent [19]

Sukornick et al.

[11] 4,088,517

[45] May 9, 1978

[54] OXIDIZING HALOGEN COMPOSITION

[75] Inventors: Bernard Sukornick, Elizabeth, N.J.; James B. Beal, Tulsa, Okla.

[73] Assignee: Allied Chemical Corporation, Morris Township, N.J.

[21] Appl. No.: 394,645

[22] Filed: Aug. 28, 1964

[51] Int. Cl.[2] ..... C06B 47/00

[52] U.S. Cl. ..... 149/1; 252/186

[58] Field of Search ..... 149/1, 22, 36, 109; 252/186

[56] References Cited

U.S. PATENT DOCUMENTS 3,221,494 12/1965 Chu ..... 149/1 X

*Primary Examiner*—Stephen J. Lechert, Jr.

*Attorney, Agent, or Firm*—Robert A. Harman; Jay P. Friedenson

EXEMPLARY CLAIM

1. A storable oxidizing composition consisting essentially of a solution of trifluoramine oxide and chlorine pentafluoride, which contains up to 25 mole % of trifluoramine oxide in liquid phase at 24° C.

5 Claims, No Drawings

OXIDIZING HALOGEN COMPOSITION

This invention relates to an oxidizing solution which is both storable and stable. More particularly, the invention is directed to the provision of a storable liquid oxidizing system, constituting chlorine pentafluoride, $ClF_5$, having incorporated therein a normally cryogenic material, trifluoramine oxide, $F_3NO$. This system is particularly suitable for use in conjuction with rocket fuels to form bipropellant mixtures.

Currently available propellant systems or fuels or oxidizers for such systems, have been classified broadly into what has been termed "storable" and "cryogenic" (non-storable). A given composition, however, may be non-storable, even though it is not normally cryogenic, because for example, the chemical composition may be inherently unstable, due to its thermodynamic properties.

For the purposes of this discussion, the meaning of the terms "storable" and "cryogenic" may be accepted essentially as defined by Chester J. Grelecki and Stanley Tannenbaum in a paper entitled, "Survey on Current Storable Propellants", printed in *American Rocket Society Journal,* Vol. 32, No. 8, pages 1189–1195, August 1962 at pages 1189–1190. Essentially, the definition of a "storable" given therein, is a material whose critical temperature is higher than about 160° F., whose vapor pressure is greater than 500 psia. at 160° F. and which may be kept for long periods of time under standard conditions, without significant decomposition or loss of material. A "cryogenic", generally defined as a substance for producing low temperatures, is indicated in the Grelecki et al. paper, supra, to describe a material whose critical temperature is below room temperature, as well as a material whose boiling point is below room temperature. For practical purposes, a cryogenic material is generally considered to refer to a substance which is capable of producing low temperatures and, as such, is normally gaseous at standard conditions.

In view of the contemplated use of propellants in rocket applications under conditions of extremely low temperatures, the desirability of propellant systems or the components thereof, possessing extremely low freezing points, is apparent. Just as clearly it can be seen that in those cases wherein cryogenic substances are employed, which normally possess relatively low boiling points, the problems of stability and storability become acute.

The ideal rocket propellant must, of course, have a high specific impulse. Additionally, insofar as possible, such a propellant should have a high density, be storable, must have a high calorific content, must be non-corrosive, must be non-toxic, must be chemically stable and its viscosity and performance characteristics must not be greatly affected by changes in temperature. The ideal propellant, possessing all of these characteristics, is not as yet known. However, for a specific application it is desirable to achieve the best possible combination of these properties.

In addition to the obvious advantage of storability, storable propellants, or storable fuel and oxidizing components thereof, have certain advantages which are not possessed by their cryogenic counterparts, and vice-versa. The greater reliability and quicker readiness of storable components and mixtures thereof, have resulted in their application, to a greater extent, for military purposes. On the other hand, the relatively low cost of cryogenic components and mixtures thereof, together with the greater ease of handling of the same, have resulted in a more extensive application of these materials to non-military purposes. The biggest and most obvious drawback to the use of cryogenic components or mixtures thereof, is that due to their extremely high vapor pressures, they are not easily storable.

According to the invention, it has been found that some of the desirable properties of a cryogenic oxidizer can be incorporated in a composition comprising a storable oxidizer, without sacrificing the storability and stability characteristics of the latter.

Accordingly, it is a major object of this invention to provide an improved oxidizing composition which is both storable and stable.

It is a further object of the invention to provide a means of incorporating a normally cryogenic oxidizer into an oxidizing system which is both storable and stable.

It is a more specific object of the invention to provide a storable and stable liquid oxidizing solution consisting essentially of solutions of trifluoramine oxide, $F_3NO$, in chlorine pentafluoride, $ClF_5$.

Another object of the invention is to provide a storable liquid oxidizing solution which, in combination with many common fuels, is capable of generating high specific impulses.

Other objects and advantages will become apparent from the following description of the invention when considered in conjunction with the examples and claims.

$F_3NO$ is a known oxidizer, classifiable as a "cryogenic," has a boiling point of about −87.5° C., a critical temperature of 29.5° C., a vapor pressure of about 925 psi. at 29.5° C. and normally appears as a colorless gas and has a vapor pressure of about 760 psia. at 24° C. $F_3NO$ is a good oxidant and develops specific impulses (ratio of total impulse to the mass of the propellant) with a number of common fuels in the order of 300 lb. sec. per lb. and upwards. Additionally, this material exhibits typically, those attributes which, as discussed above, are characteristic of cryogenic oxidizers, in general. $F_3NO$ may be prepared as disclosed in copending, commonly-assigned, application Ser. No. 276,105, filed Apr. 26, 1963, by heating NOF and elemental fluorine at temperatures of at least about 150° C. and at pressures at least about 2000 psig.

$ClF_5$ is a known oxidizer, classifiable as a "storable", has a boiling point of about −13.6° C., a critical temperature of 119° C., a vapor pressure of about 57 psia. at 24° C. and when pure, appears as a colorless liquid. $ClF_5$ is also a good oxidant and develops specific impulses in excess of 300 lb. sec. per lb. with many common fuels. It may be prepared, as disclosed in the literature, by the direct combination of chlorine and fluorine at temperatures up to 285° C. and at pressures in the range of about 500–1500 psig.

In accordance with the invention, it has been found that $F_3NO$ and $ClF_5$ are compatible and miscible in all proportions and, in certain proportions, form a solution which comprises a storable and stable liquid oxidizer, having incorporated therein a normally cryogenic material. The result is a liquid oxidizing solution which combines the attributes of a cryogenic oxidizer with the storability and other advantageous characteristics of a storable oxidizer.

It is not known whether there is any chemical interaction between $F_3NO$ and $ClF_5$. NMR spectra did not reveal any discernible interaction, e.g. fluorine-bridging. As the $F_3NO$, however, is satisfactorily retained in solution with the $ClF_5$ under conditions which can practically be contemplated for use; it is immaterial whether $F_3NO$ and $ClF_5$ be associated chemically or merely physically and the invention is not to be limited by any particular theory.

Although $F_3NO$ and $ClF_5$ are compatible, miscible and usable in all proportions, over any range of temperatures; the higher the temperature and the greater the proportion of $F_3NO$ and $ClF_5$ — the higher will be the pressure of the system. It is desirable, of course, for storability purposes, that the vapor pressure of the system be as low as possible. It has been found that mixtures containing at least about 75 mole % of $ClF_5$ or mixtures containing up to about 25 mole % of $F_3NO$ and $ClF_5$, in liquid phase, at 24° C., for example, are suitable for use. Mixtures containing from about 10–20 mole % of $F_3NO$ in $ClF_5$, in liquid phase, at 24° C., are very suitable for use. The pressure of the 25% solution at 24° C. is about 99 psig.

Tables I and II show vapor pressure data for $ClF_5$ and $F_3NO$ at various temperatures.

TABLE I

| $ClF_5$ Vapor Pressure (psia.) at | | | | |
|---|---|---|---|---|
| −80° C. | −63 ° C. | −23° C. | 0° C. | 24° C. |
| ~0.5 | ~1.0 | ~5.0 | ~26 | ~57 |

TABLE II

| $F_3NO$ Vapor Pressure (psia.) at | | | | |
|---|---|---|---|---|
| −80° C. | −63 ° C. | −23° C. | 0° C. | 24° C. |
| ~22 | ~51 | ~222 | ~428 | ~760 |

The values for the vapor pressures given in Table II, for example, represent approximations based on available data. The vapor pressure equation used to calculate pressure of $F_3NO$ at the various temperatures was:

$$\log P_{mm} = \frac{-844.493}{T^\circ \text{ (Absolute)}} + 7.4276$$

The pressures achieved for compositions condensed into an NMR tube, at various temperatures, for 4:1, 2:1 and 1:1 molar ratios of $ClF_5$ to $F_3NO$, are shown in Tables III, IV and V, respectively.

TABLE III $F_3NO$ IN $ClF_5$
Molar ratio of $ClF_5$ to $F_3NO$–4:1

| | Vapor Pressure* (psia.) of System at | | | Mole % $F_3NO$ from NMR Data (Liquid Phase) | | |
|---|---|---|---|---|---|---|
| Run | −23° C. | 24° C. | 0° C. | −65° C. | −30° C. | 24° C. |
| 1 | 22.75 | >45 | 32 | 13 | >8 | 12.2±1 |
| 2 | 22.50 | 68 | 34 | | 10 | |
| 3 | 22.50 | 67 | 36.6 | | | |
| 4 | | 67 | 37.0 | | | |
| 5 | | 67 | 35.5 | | | |
| 6 | | 67 | 35.5 | | | |
| 7 | | | 37.0 | | | |

*Pressures were measured with a Marsh bronze movement gauge, compound 30 in. Hg-0-30 psig. with 1 inch and 1 lb. increments and converted to psia.

TABLE IV $F_3NO$ IN $ClF_5$
Molar ratio of $ClF_5$ to $F_3NO$–2:1

| | Vapor Pressure* (psia.) of System at | | | | Mole % $F_3NO$ from NMR Data (Liquid Phase) | |
|---|---|---|---|---|---|---|
| Run | −63° C | −23° C. | 0° C. | 24° C. | −30° C. | 24° C. |
| 1 | 13.9 | >30 | 57 | 92 | 22 | 14.3 |
| 2 | 14 | 47 | 57 | 85 | | |
| 3 | 13.9 | 43 | 57 | 82 | | |
| 4 | 13.9 | 43 | 57 | 82 | | |
| 5 | | 43 | | 82 | | |

*Pressures below 15 psig. were measured with a Marsh bronze-movement compound gauge, 30 in. (Hg)-0-15 psig. (1"and 1 lb.increments). Pressures above 15 psig. were measured with a Marsh AA SS 316 Ammonia guage, 0–150 psig. (1 lb. increments) and converted to psia.

TABLE V $F_3NO$ IN $ClF_5$
Molar ratio of $ClF_5$ to $F_3NO$–1:1

| | Vapor pressure* (psia.) of System at | | | | Mole % $F_3NO$ From NMR Data (Liquid Phase) |
|---|---|---|---|---|---|
| Run | −63° C. | −23° C. | 0° C. | 24° C. | 24° C. |
| 1 | 21.0 | 69 | 87 | 128 | 25% |
| 2 | 21.0 | 67 | 88 | 114 | |
| 3 | 21.0 | 60 | 83 | 114 | |
| 4 | 18.0 | 57 | 83 | 114 | |
| 5 | 21.0 | 57 | 83 | | |
| 6 | 22.0 | 57 | 83 | | |
| 7 | 19.0 | | | | |
| 8 | 21.0 | | | | |

*Pressures below 15 psig. were measured with Marsh compound gauge 30 in. (Hg)-0-15 psig. – above 15 psig. with Marsh Ammonia gauge, 0–150 psig. and converted to psia.

The oxidizing solution of the invention may be prepared simply by mixing the desired quantity of one component with the desired quantity of the other, in any conventional manner. For example, gaseous $F_3NO$ may be bubbled through a vessel containing liquid $ClF_5$. Most efficiently, in general practice, the desired number of moles of $F_3NO$ and $ClF_5$ are condensed into a suitable container and the resulting solution is allowed to attain equilibrium.

The pressure of the resulting solution and the composition of the same can be conveniently determined by condensing the quantities of $F_3NO$ and $ClF_5$ from a standard vacuum manifold into a conventional Halon NMR tube. A valve, suitable of Monel or other noncorrosive material, controls flow to and from the vacuum manifold. The condensate, before passing into the NMR tube passes through a T — or Y — shaped member which is connected at one end to a pressure gauge and at the other, to a valve, suitable of stainless steel or Monel, for example, which controls flow to and from the NMR tube. The former valve is closed, the latter valve is opened and the mixture condensate is allowed to attain equilibrium at the desired temperature in the NMR tube. The pressure corresponding to this temperature may then be read and recorded from the pressure gauge. The sample may then be recondensed into the NMR tube, the valve leading to the NMR tube closed and the composition of the resulting solution determined by Nuclear Magnetic Resonance analysis.

To achieve the objects of the invention, $ClF_5$ and $F_3NO$ are conveniently combined in molar ratios of from about 4:1 to about 1:1. In this manner, the liquid phase of the $F_3NO/ClF_5$ system will contain up to about 25 mole % of $F_3NO$.

Referring back to Table V, for illustrative purposes; such 1:1 molar mixtures of $F_3NO$ in $ClF_5$ have a calculated pseudocritical temperature of 74° C. (165° F.)

Accordingly, the true critical temperature of the mixture will be at least 165° F. At 160° F., the vapor pressure of a 1:1 molar mixture of $F_3NO$ in $ClF_5$ is well below 500 psia. Such mixtures have been stored for weeks without perceivable decomposition. It therefor is seen that the characteristics of critical temperature, vapor pressure and low decomposition rate of mixtures of $F_3NO$ in $ClF_5$ meet the requirements discussed hereinbefore for "storables" and accordingly can be classified as such.

EXAMPLE 1

A sample containing 3.2 mmoles each of chlorine pentafluoride and trifluoramine oxide, was condensed and charged to an NMR tube as described hereinbefore and the solution was allowed to attain equilibrium. The pressure at 24° was 99 psig. The concentration of trifluoramine oxide in the solution, liquid phase, was found to be 25 mole % by Nuclear Magnetic Resonance analysis.

EXAMPLE 2

A sample, containing 3.2 mmoles of chlorine pentafluoride and 1.6 mmoles of trifluoramine oxide, was condensed and charged into the NMR tube and the solution was allowed to attain equilibrium. The pressure at 24° was 64 psig. The concentration of trifluoramine oxide in the solution, liquid phase, was found to be 14.3 mole % by Nuclear Magnetic Resonance analysis.

EXAMPLE 3

A sample containing 3.2 mmoles of chlorine pentafluoride and 0.8 mmoles of trifluoramine oxide was condensed and charged into the NMR tube and the solution was allowed to attain equilibrium. The pressure at 24° was 42 psig. The concentration of trifluoramine oxide in the solution, liquid phase, was found to be 12 mole % by Nuclear Magnetic Resonance analysis.

Solutions of $F_3NO$ in $ClF_5$ make excellent liquid oxidizers and generate high specific impulses with a variety of common fuels: hydrazine, monomethylhydrazine, unsymmetrical dimethylhydrazine, pentaborane and aluminum hydride being exemplary. The subject oxidizing solutions may be used as propellants in conjunction with the common fuels as is conventional in the art.

In addition to its other advantageous properties already described, mixtures of $F_3NO$ in $ClF_5$ have a high density, are easily handled, are chemically stable and are not readily deteriorated.

Although the invention has been described in the specification with some specificity, in some particulars, it is intended not to be limited thereby but only by the scope of the following claims.

We claim:

1. A storable oxidizing composition consisting essentially of a solution of trifluoramine oxide and chlorine pentafluoride, which contains up to 25 mole % of trifluoramine oxide in liquid phase at 24° C.

2. A storable oxidizing composition consisting essentially of a solution of trifluoramine oxide and chlorine pentafluoride, which contains from about 12.1 to about 25 mole % of trifluoramine oxide in liquid phase at 24° C.

3. A storable oxidizing composition consisting essentially of a solution of trifluoramine oxide and chlorine pentafluoride, which contains from about 10 to about 20 mole % of trifluoramine oxide in liquid phase at 24° C.

4. A storable oxidizing composition consisting essentially of a solution of trifluoramine oxide and chlorine pentafluoride, which contains about 14.3 mole % of trifluoramine oxide in liquid phase at 24° C.

5. A storable oxidizing composition consisting essentially of a solution of trifluoramine oxide and chlorine pentafluoride, which contains about 8.0 mole % of trifluoramine oxide in liquid phase at 30° C.

* * * * *